United States Patent [19]

Gould

[11] 4,167,862

[45] Sep. 18, 1979

[54] ANTI-THEFT DEVICE FOR AIRCRAFT

[76] Inventor: Thomas W. Gould, 2155 E. Hale St., Mesa, Ariz. 85203

[21] Appl. No.: 652,841

[22] Filed: Jan. 27, 1976

[51] Int. Cl.[2] ..... E05B 73/00

[52] U.S. Cl. ..... 70/18; 244/1 R; 416/146 R

[58] Field of Search ..... 244/1 R, 83 A, 13; 73/455, 456; 70/18, 57, 58, 417; 416/62, 146; 59/78

[56] References Cited

U.S. PATENT DOCUMENTS

| | | | |
|---|---|---|---|
| 1,376,114 | 4/1921 | Raney | 70/18 |
| 2,486,672 | 11/1949 | Notestein et al. | 416/146 |
| 2,541,704 | 2/1951 | Koppen | 244/13 |
| 3,091,011 | 5/1963 | Campbell | 70/57 |
| 3,288,401 | 11/1966 | Fete | 244/83 A |
| 3,775,969 | 12/1973 | Vasterling | 59/78 |
| 3,808,847 | 5/1974 | Vesely | 70/18 |
| 3,850,014 | 11/1974 | Flack | 70/417 |

*Primary Examiner*—Kenneth J. Dorner
*Attorney, Agent, or Firm*—Herschel C. Omohundro

[57] ABSTRACT

This anti-theft device has a plurality of arcuate metallic sections hingedly connected to be removably applied to an airplane propeller blade at one side of the propeller shaft and locked in place to prevent unauthorized removal. The device forms an eccentric weight mass which when the engine is operated, causes vibrations so severe that the aircraft cannot take off or fly successfully. A warning flag or banner is attached to the device and anyone at all familiar with aircraft operation will not attempt to take the plane.

5 Claims, 7 Drawing Figures

ANTI-THEFT DEVICE FOR AIRCRAFT

BACKGROUND OF THE INVENTION

Since small private aircraft have come into popular use, thefts of such craft have become a serious problem. It is practically impossible, due to the type of ignition and other features of construction of small aircraft, to prevent unauthorized individuals from removing and replacing wires and then operating the aircraft. To solve such problem it has been proposed to apply a mass of predetermined weight to the aircraft propeller in a manner to unbalance it. If the engine is started with the propeller unbalanced severe vibration will result and the craft cannot be flown.

SUMMARY

An object of this invention is to provide an anti-theft device for small private aircraft which will be simple to manufacture and use, economical to purchase and maintain yet effective in the prevention of theft of such aircraft.

Also an object of the invention is to provide an anti-theft device for small private aircraft, the device having a plurality of hingedly connected arcuate sections which may be arranged around a propeller blade at one side of its hub and secured in place to prevent unauthorized removal, the device serving to unbalance the propeller to such an extent that operation of the plane would be hazardous if not impossible.

Another object of the invention is to provide the anti-theft device referred to in the preceding paragraph with a pair of semi-circular sections having a pair of their ends pivotally connected so that the sections may be looped around one blade of an aircraft propeller and the other ends secured by a suitable lock to prevent unauthorized removal, the device then providing an eccentric mass which will unbalance the propeller and prevent safe operation of the aircraft.

A further object is to harden the material of the sections and the lock to a depth to resist cutting with ordinary tools thus increasing the anti-theft qualities of the device.

A still further object of the invention is to provide the device with a warning flag or banner calling attention to the presence of the device and reminding a potential operator of the aircraft that it must be removed before the craft can be safely operated.

An object also is to provide the device mentioned in previous paragraphs with a length of flexible material, such as cable or chain, secured at its ends to the sections in such a manner that it can be looped around the propeller shaft when the anti-theft device is applied to a propeller with blades which taper from the hub to the tip and thus might permit the device to be slipped off the blade. When the cable or chain is extended around the shaft as suggested above the anti-theft device is restrained against slipping off the blade and the propeller will be unbalanced as in the forms of the invention first mentioned.

With the foregoing and other objects in mind, which will appear as the description proceeds, the invention consists in the novel features of construction and arrangements of parts which are illustrated in detail in the accompanying drawing.

IN THE DRAWING

DESCRIPTION

Figure 1:
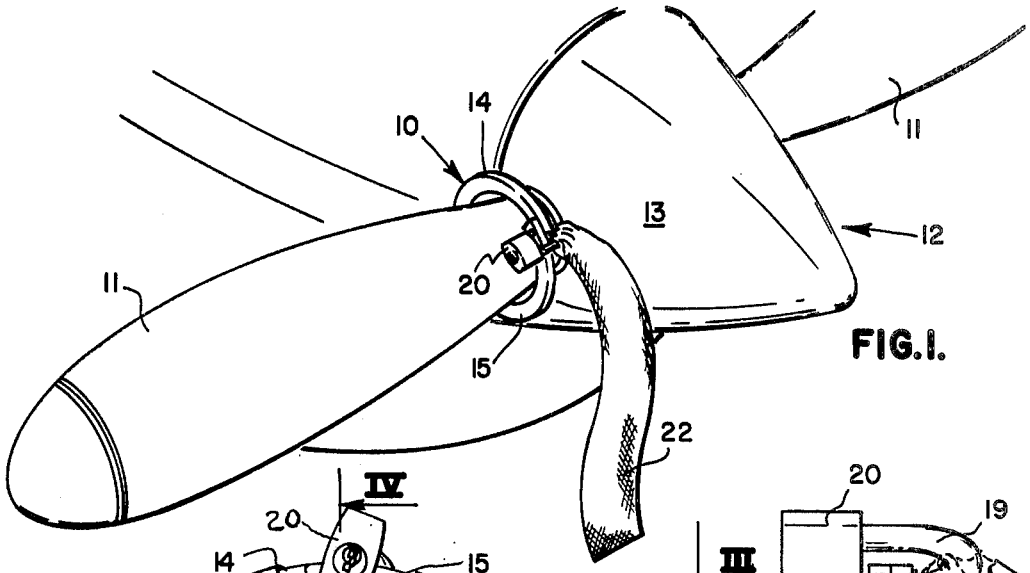
FIG. 1 is a perspective view of part of an aircraft propeller with an anti-theft device formed in accordance with the present invention applied thereto.
Figure 6:
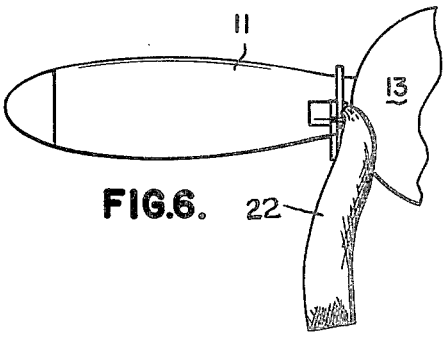
FIG. 6 is a front elevational view of a propeller of a certain type with the anti-theft device applied thereto.

Referring more particularly to the drawing the numeral 10 designates generally an anti-theft device formed in accordance with the invention. FIGS. 1 and 6 illustrate the device 10 applied to one blade 11 of an aircraft propeller, indicated generally by the numeral 12. Generally, propellers, such as 12, have a streamlined cowling or spinner 13 covering the propeller shaft end or hub.

Figure 2:
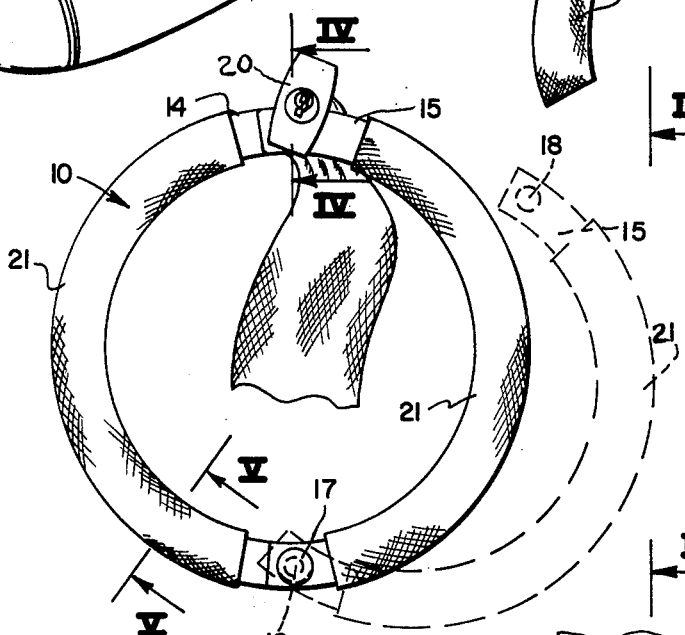
FIG. 2 is a detail front elevational view of the anti-theft device shown in FIG. 1, the device being shown in locked condition in full lines and a part in unlocked condition in dotted lines.
Figure 3:
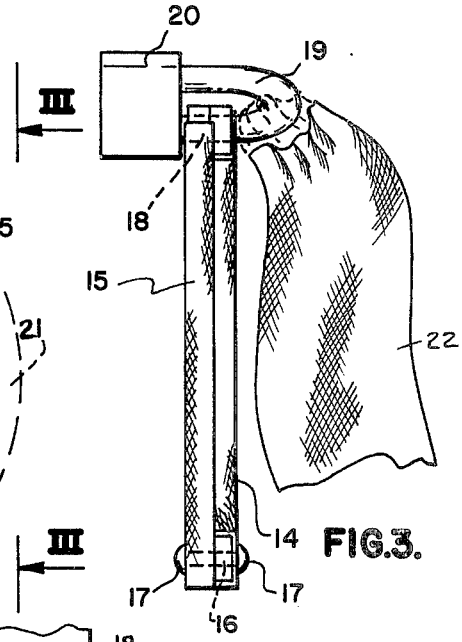
FIG. 3 is a side elevational view of the device taken on the plane indicated by the line III—III of FIG. 2.

The anti-theft device 10, in the form selected for illustration, has a plurality of arcuate sections 14 and 15 hingedly connected at a pair of their ends by a pivot 16 which may be of suitable shape, the one shown being a length of rod with heads 17 upset on opposite ends to retain the pivot in place. The pivot is so applied as to permit the sections to be moved relative to one another, as indicated by dotted lines in FIG. 2, and applied to or removed from one blade of a propeller adjacent the hub or spinner 13. The form of the invention shown has two substantially semi-circular sections 14 and 15 which are of a size to relatively loosely fit the reduced portion of a propeller blade near the hub.

Figure 4:
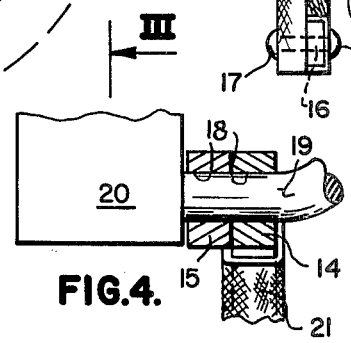
FIG. 4 is a detail sectional view taken through the device on the plane indicated by the line IV—IV of FIG. 2.
Figure 5:
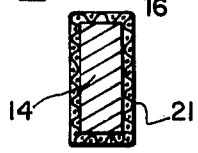
FIG. 5 is a similar view taken on the plane indicated by the line V—V of FIG. 2.

The ends of the sections opposite those receiving the pivot 16 are each provided with a hole 18, which holes may be aligned, as shown in FIG. 4, when the free ends of the sections are disposed in side by side relationship after applying the device to a propeller. The holes 18 receive the hasp 19 of a padlock 20 used to prevent the unauthorized removal of the device 10. It will be obvious that when the device 10 is secured to an aircraft propeller, as shown and described, it will add the weight mass of the sections 14 and 15, the pivot 16, and the lock 20 to the propeller. Since such weight mass is disposed eccentric to the axis of rotation of the propeller, rotary movement thereof will set up unbalanced centrifugal forces which cause serious vibrations. Such vibrations will be amplified in accordance with speed increases in engine operation until use of the aircraft would be impossible.

To prevent the arcuate sections 14 and 15 from scratching or otherwise marring the propeller, the sections are substantially encased in woven nylon or other suitable fabric tubing 21. This material may be naturally resistant, or it may be treated to be resistant, to burning in the event a potential thief should attempt to use a torch to remove the device. To further resist attempts at unauthorized removal of the device, the material of the sections, the pivot, and the lock are selected to permit hardening thereof, after formation, to a depth to successfully resist cutting with normal or conventional tools, such as saws, files, bolt cutters, and the like.

It was pointed out in the objects that to make the device safe for use, a flag or banner 22 is attached to the lock, a warning being printed or otherwise applied to the banner, to remind authorized users to remove the anti-theft device before starting the aircraft engine. To further safeguard the aircraft a second warning may be applied in the form of a bag-like container for the device, such bag having a similar warning imprinted thereon, the bag being sized and shaped to be draped over the steering wheel of the aircraft.

Figure 7:
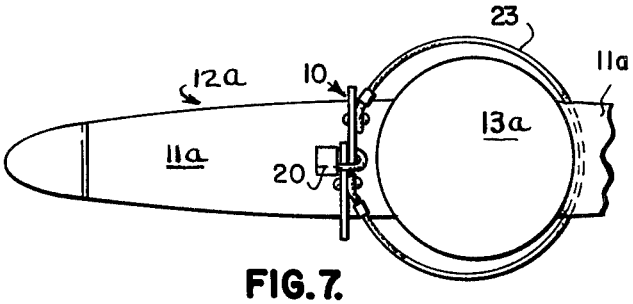
FIG. 7 is a similar view of a different type of propeller with a slightly modified type of anti-theft device in operative position thereon.

In FIG. 7 a modified form of anti-theft device has been illustrated. Fundamentally this form is similar to the form shown in FIGS. 1 to 6, inclusively, in having sections 14 and 15 and lock 20 all constructed and connected in the same way but with the addition of of a flexible element 23, such as a cable or chain, connected at its ends to the sections and adapted to be trained around a propeller shaft or hub 13*a* and in back of the blade 11*a* opposite that to which the arcuate sections are applied. This form of anti-theft device is provided for use on propellers 12*a* which taper from the hub to the tips and do not have reduced or neck portions adjacent the hub, as shown in FIGS. 1 and 6. The cable 23 will prevent the ring-like body, formed by the semi-circular sections 14 and 15, from being slipped off the propeller blade 11*a*. It is obvious that the cable will also be treated to make it resistant to cutting to prevent unauthorized removal. It may also have a casing of protective material to prevent scratching or marring the finish of the propeller.

While the invention has been illustrated in a preferred form with two semi-circular sections to make a ring it should be obvious that other, or modified, shapes could be employed without departing from the spirit and scope of the invention shown and described, the gist of the invention being the application of an eccentric mass to the propeller of an aircraft to set up vibrations, when the engine is operated, severe enough to prevent flight.

I claim:

1. An anti-theft device for an aircraft comprising:

(a) a mass of predetermined weight shaped to be removably applied to an aircraft propeller to unbalance such propeller, said mass having a pair of substantially semi-circular sections hinged together for pivotal movement; and (b) means securing said mass in applied position on the propeller to prevent unauthorized removal of said mass.

2. The anti-theft device of claim 1 in which the free ends of the semi-circular sections have openings registering in the applied position of said mass, and said securing means is a lock with a portion extending through the registering openings in said sections.

3. The anti-theft device of claim 1 in which the substantially semi-circular sections are formed of metal bar with a rectangular cross section, one pair of ends of the sections overlap and are pivotally joined by a hardened metal pivot, the other ends are formed with openings which register when the device is operatively positioned, and the securing means constitutes a lock with a hasp extending through the registering openings to prevent unauthorized removal of the device.

4. An anti theft device for aircraft driven by at least one propeller having a plurality of blades, said device comprising:

a. means connectable to a propeller for imposing a destructive load upon the aircraft power plant;

b. said load imposing means having a structural configuration effective to circumscribe the root of one blade of the propeller;

c. said load imposing means including locking means which prevents the unauthorized removal of said load imposing means that is circumscribing the root of said blade;

d. said load imposing means having sufficient weight to provide an effective imbalance to the propeller to damage at least the power plant upon actuation thereof.

5. A method for precluding motorized flight of propeller driven aircraft, said method comprising the steps of:

a. engaging a frame partially about the root of a blade of the propeller for unbalancing the propeller;

b. attaching lock bar means to the frame for securing the frame to the root of the blade; and c. locking the lock bar means to the frame for precluding disengagement of the lock bar means and the frame and precluding removal of the frame from about the root of the blade; whereby the destructive effect of the unbalanced propeller inhibits full power development by the power plant and precludes takeoff of the aircraft.

* * * * *